US009518465B2

(12) United States Patent
Burger et al.

(10) Patent No.: US 9,518,465 B2
(45) Date of Patent: Dec. 13, 2016

(54) METHOD AND DEVICE FOR TRANSPORTING OVERBURDEN AWAY DURING TUNNELLING

(71) Applicant: HERRENKNECHT AKTIENGESELLSCHAFT, Schwanau (DE)

(72) Inventors: Werner Burger, Schwanau (DE); Michael Strässer, Darmstadt (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 0 days.

(21) Appl. No.: 14/434,304

(22) PCT Filed: Oct. 7, 2013

(86) PCT No.: PCT/EP2013/070839
§ 371 (c)(1),
(2) Date: Apr. 8, 2015

(87) PCT Pub. No.: WO2014/060234
PCT Pub. Date: Apr. 24, 2014

(65) Prior Publication Data

US 2015/0233243 A1 Aug. 20, 2015

(30) Foreign Application Priority Data

Oct. 19, 2012 (DE) ..... 10 2012 219 134

(51) Int. Cl.
*E21D 9/12* (2006.01)
*E21D 9/13* (2006.01)

(52) U.S. Cl.
CPC ..... *E21D 9/124* (2013.01); *E21D 9/12* (2013.01); *E21D 9/13* (2013.01)

(58) Field of Classification Search
CPC ..... E21D 9/12; E21D 9/124; E21D 9/13
See application file for complete search history.

(56) References Cited

U.S. PATENT DOCUMENTS 4,456,305 A * 6/1984 Yoshikawa ..... E21D 9/12 198/657
5,180,252 A * 1/1993 Tanaka ..... E21D 9/081 299/33
5,203,614 A * 4/1993 Robbins ..... E21D 9/13 299/1.9

FOREIGN PATENT DOCUMENTS

DE 8530392 U1 10/1986
DE 29914815 U1 12/2000
DE 19700297 C2 5/2001
(Continued)

OTHER PUBLICATIONS

International Search Report and Written Opinion mailed Feb. 5, 2015 from the ISA-EP.

*Primary Examiner* — David Bagnell
*Assistant Examiner* — Michael Goodwin
(74) *Attorney, Agent, or Firm* — Faegre Baker Daniels LLP

(57) ABSTRACT

A method and device for transporting overburden away during tunneling includes a seal that separates a first portion and a second portion of a transporting screw arrangement. As a result, in open tunneling or in earth-pressure-assisted tunneling, when the seal is closed, overburden can be transported out of a first opening, arranged ahead of the seal in the direction of removal and, in fluid-assisted tunneling, when the first opening is closed and the seal is open, the overburden can be transported into the second portion.

3 Claims, 9 Drawing Sheets

(56) References Cited

FOREIGN PATENT DOCUMENTS

JP H1122387 A 1/1999

* cited by examiner

METHOD AND DEVICE FOR TRANSPORTING OVERBURDEN AWAY DURING TUNNELLING

CROSS-REFERENCE TO RELATED APPLICATION

This application is a U.S. National Phase Patent Application based on International Application Serial No. PCT/EP2013/070839 filed Oct. 7, 2013, the disclosure of which is hereby explicitly incorporated by reference herein.

BACKGROUND OF THE INVENTION

1. Field of the Invention

The present invention relates to a method for conveying excavated material away during tunneling.

2. Description of the Related Art

Such a method and device are known from DE 197 00 297 C2. The prior device and method for conveying excavated material away during tunneling involve a conveying system comprising a screw conveyor unit disposed in a jacket. The jacket is provided with a first opening, at the working-chamber end, and a second opening, remote from the working chamber. The openings are opened and closed by means of selectively operable seals. A system for airlocking excavated material out is also present, and is adapted to maintain a counterpressure in the jacket. In tunneling using slurry conveyance, the first opening, at the working chamber end, is open, the second opening, remote from the working chamber, is closed and the airlock discharge system is not operating. In earth pressure balance tunneling, the first opening, at the working chamber end, and the second opening, remote from the working chamber, are closed, whereas the airlock discharge system is operating. In open tunneling, the first opening, at the working chamber end, is closed, the second opening, remote from the working chamber, is open and the airlock discharge system is not operating.

SUMMARY OF THE INVENTION

The present invention provides a method and a device for conveying excavated material away during tunneling that are distinguished by failure-resistant and low-wear operation.

By virtue of the fact that according to the invention, in the case of the method, in unpressurized open tunneling or in earth pressure balance tunneling excavated material is discharged from a first opening, disposed first in the direction of conveyance, and in the case of the device, in order to deactivate the system fluid-mechanically a second opening located downstream of the first opening in the direction of conveyance is deactivated, a manner of operation is obtained that is relatively failure-resistant and low-wear, since this abrasive excavated material is discharged early.

In one form thereof, the present invention provides method for conveying excavated material away during tunneling, wherein, in an open tunneling operation or in an earth pressure balance tunneling operation, a first opening, disposed first in the direction of conveyance, of a conveying system is open and a second opening, downstream of the first opening, is closed, and in a slurry tunneling operation the first opening is closed and the second opening is open.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Therein.

DETAILED DESCRIPTION

Figure 1:
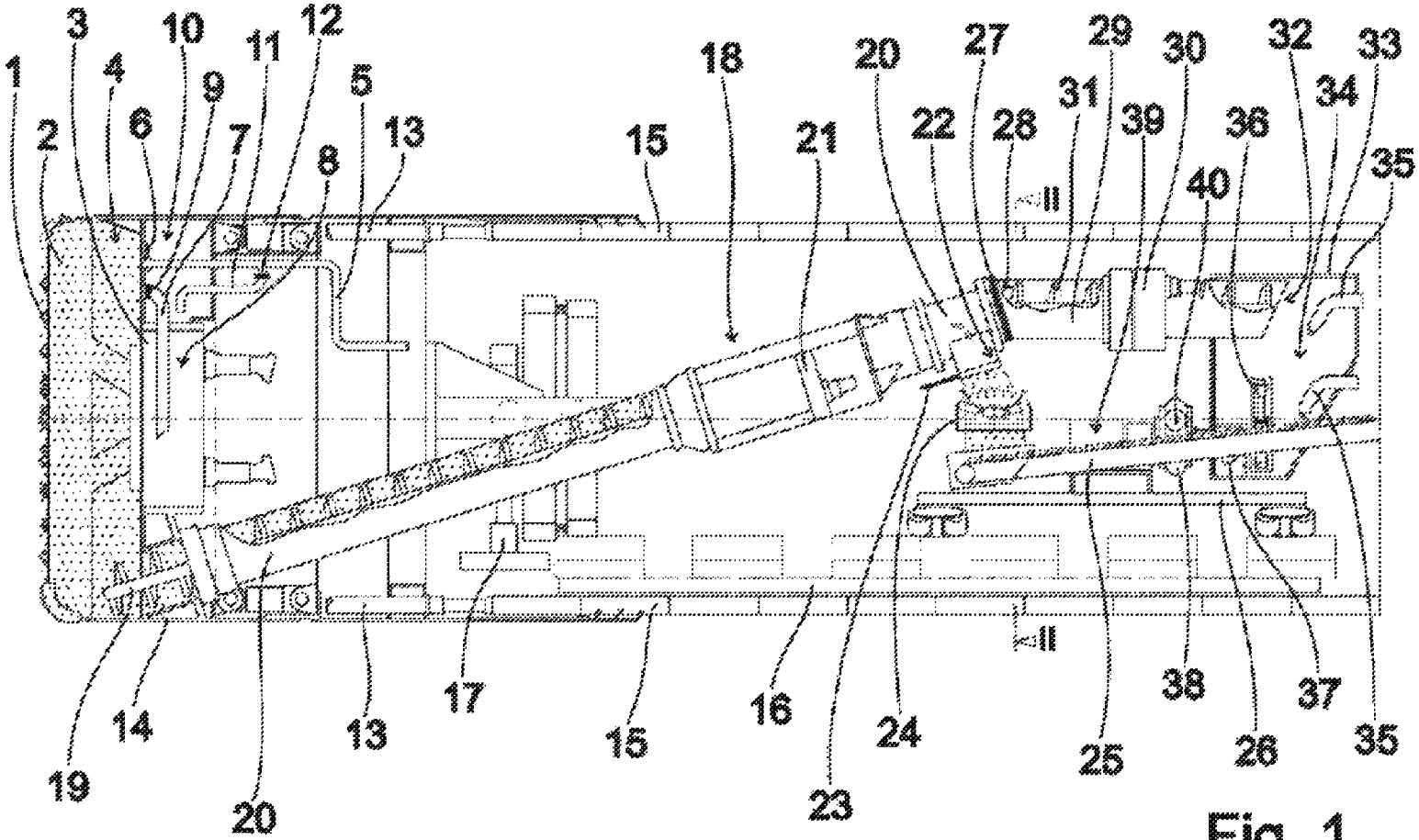
FIG. 1 is a descriptive side view of an exemplary embodiment of a device according to the invention, comprising a tunnel boring machine engaged in earth pressure balance tunneling.

FIG. 1 is a descriptive side view of a tunnel boring machine equipped with an exemplary embodiment of a device according to the invention for conveying excavated material away and operated according to the method of the invention. The tunnel boring machine according to FIG. 1 comprises a cutting wheel 2, which is fitted with excavation tools 1 and is drivable in rotation by means of a cutting wheel drive 3. A working chamber 4 located behind the cutting wheel 2 in a tunneling direction, in the case of the earth pressure balance tunneling illustrated in FIG. 1, also known as EPB mode, is filled with excavated material to be removed and is also filled with shield flushing liquid that is fed in as needed via a shield flushing liquid feed line 5 when a working chamber slide valve 6 is opened.

Also opening into the working chamber 4 is an overflow line 7, which is in communication with a buffer chamber 8 surrounded by the cutting wheel drive 3. The communication between the working chamber 4 and the buffer chamber 8 via the overflow line 7 is to be sealed or opened, as needed, by means of an overflow line slide valve 9, to maintain pressure conditions in the working chamber 4 that are suitable for EPB mode.

Located in back of the working chamber 4 in the tunneling direction is an annular gap 10 into which a branch 11 of the shield flushing liquid feed line 5 opens, said branch 11 being sealable by means of an annular gap slide valve 12.

The tunnel boring machine according to FIG. 1 further comprises thrust cylinders 13, which move the cutting wheel 2 and a shield 14 along in the tunneling direction by pushing against lining segments 15. The lining segments 15 can, in turn, be installed by means of a lining segment feed unit 16 and a lining segment positioning unit 17 in order to line a tunnel wall.

The tunnel boring machine according to FIG. 1 is equipped with a conveyor system 18, as a device for conveying excavated material away, which in the exemplary embodiment depicted in FIG. 1 has a main screw conveyor 19 that is formed with a core and surrounded by a main screw conveyor cladding tube 20 and that extends away from the cutting wheel 2, in the opposite direction from the tunneling direction, from an open end projecting into the working chamber 4 and encapsulatedly on through the annular gap 10. The main screw conveyor 19 is drivable in rotation in two rotational directions by means of a main screw conveyor drive 21, in one of which directions of rotational conveyance, excavated material present in the working chamber 4, together with, in particular, shield flushing liquid fed in through the shield flushing liquid feed line 5 and any desired further inputs from the working chamber 4, can be conveyed away in the opposite direction from the tunneling direction.

Located at the end of the main screw conveyor cladding tube 20 remote from the working chamber 4 is a main screw conveyor outlet 22, which is provided as a first, working-chamber-end opening in the main screw conveyor cladding tube 20 and which can selectively be sealed by means of a main screw conveyor outlet sealing slide valve 23 as a first seal. Disposed in the ejection direction of the main screw conveyor outlet 22 is a transverse conveyor belt 24, by means of which material containing extracted material emerging from the main screw conveyor outlet 22 and intended for removal can be transported away transversely to the tunneling direction and transferred to a backup conveyor belt 25 which conveys material oppositely to the tunneling direction, but which can also be moved, together with a backup system 26, in the tunneling direction.

It is also apparent from the representation according to FIG. 1 that the main screw conveyor cladding tube 20 is sealed behind the main screw conveyor outlet 22 by means of a transitional-opening throughpass slide valve 27, as a second seal, by means of which a transitional-opening throughpass 28 formed by the cross section of the main screw conveyor cladding tube 20 and provided as a second opening can be sealed, thereby fluid-mechanically deactivating a downstream screw conveyor cladding tube 29 adjoining the main screw conveyor cladding tube 20 in the conveying direction and containing a downstream screw conveyor 31, which is also a component of the conveyor system 18 and which can be rotated by means of a downstream screw conveyor drive 30.

The downstream screw conveyor cladding tube 29 opens, by its end remote from the main screw conveyor cladding tube 20, via a downstream screw conveyor outlet 32 into a flushing chamber 34 that is enclosed by a flushing box 33 and is part of a removal unit into which flushing-box flushing-liquid feed lines 35 open that can be supplied with flushing liquid. Disposed in the flushing box 33 is a jaw crusher 36, by means of which, as will be described in more detail below, coarse components conveyed into the flushing box 33 can be made smaller. Opening into a floor region of the flushing box 33 is a delivery line suction pipe 37 that is part of the removal unit and is connected to a feed pump 38 of the removal unit, and by means of which material conveyed into the flushing box 33 and containing components of relatively low viscosity and only relatively small particle size can be sucked out of the flushing box 33. By means of the feed pump 38, which can be driven via a feed pump drive 39, relatively low-viscosity material in the flushing chamber 34 can be transported to a discharge line arrangement 40 of the removal unit.

Figure 2:
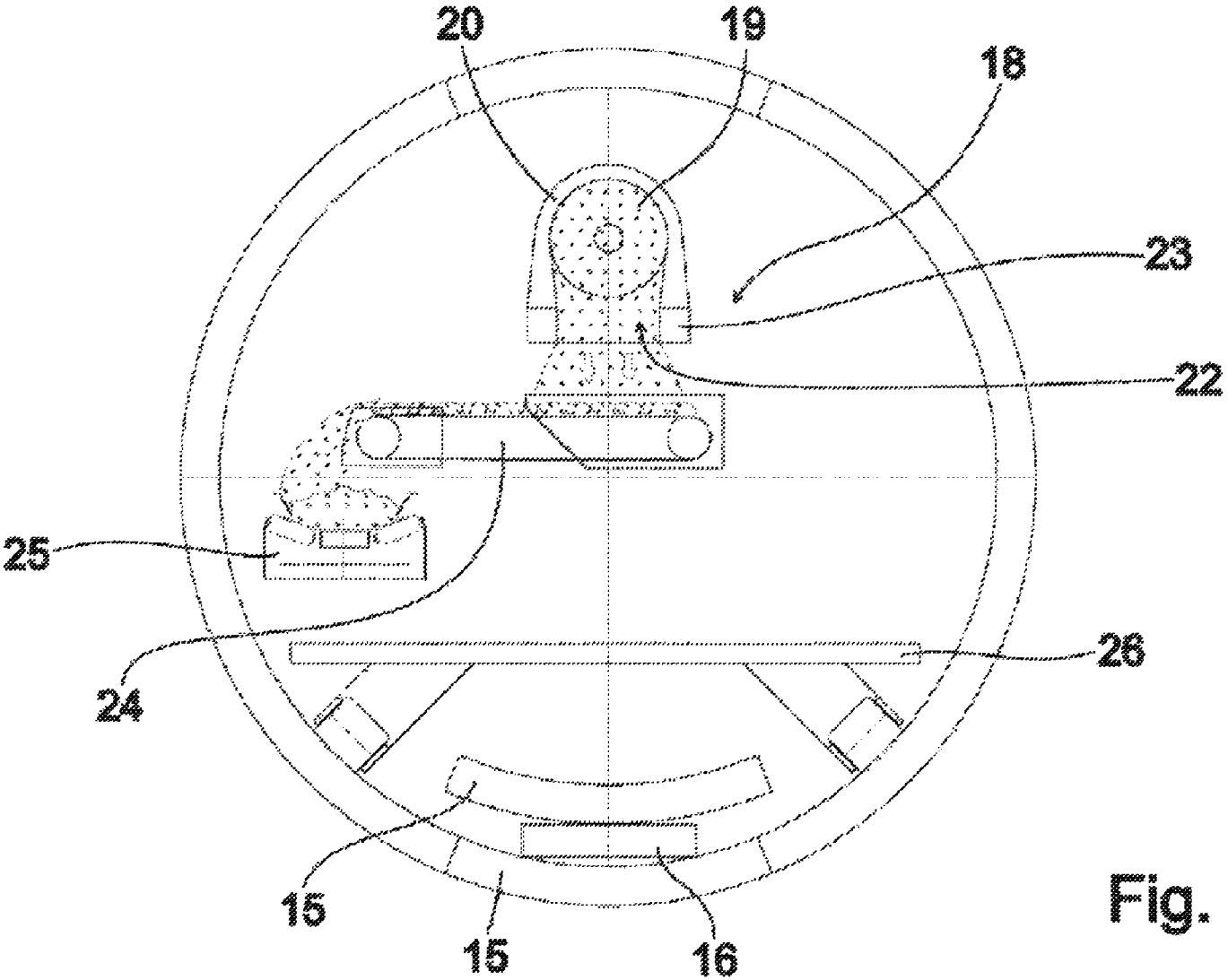
FIG. 2 shows the exemplary embodiment according to FIG. 1 in a sectional view along line II-II.

FIG. 2 shows the exemplary embodiment according to FIG. 1 in a sectional view along line II-II, looking in the tunneling direction. It can be seen from FIG. 2 that owing to the arrangement of the transverse conveyor belt 24 crosswise to the tunneling direction or removal direction, a clearance is created under the main screw conveyor cladding tube 20.

Figure 3:
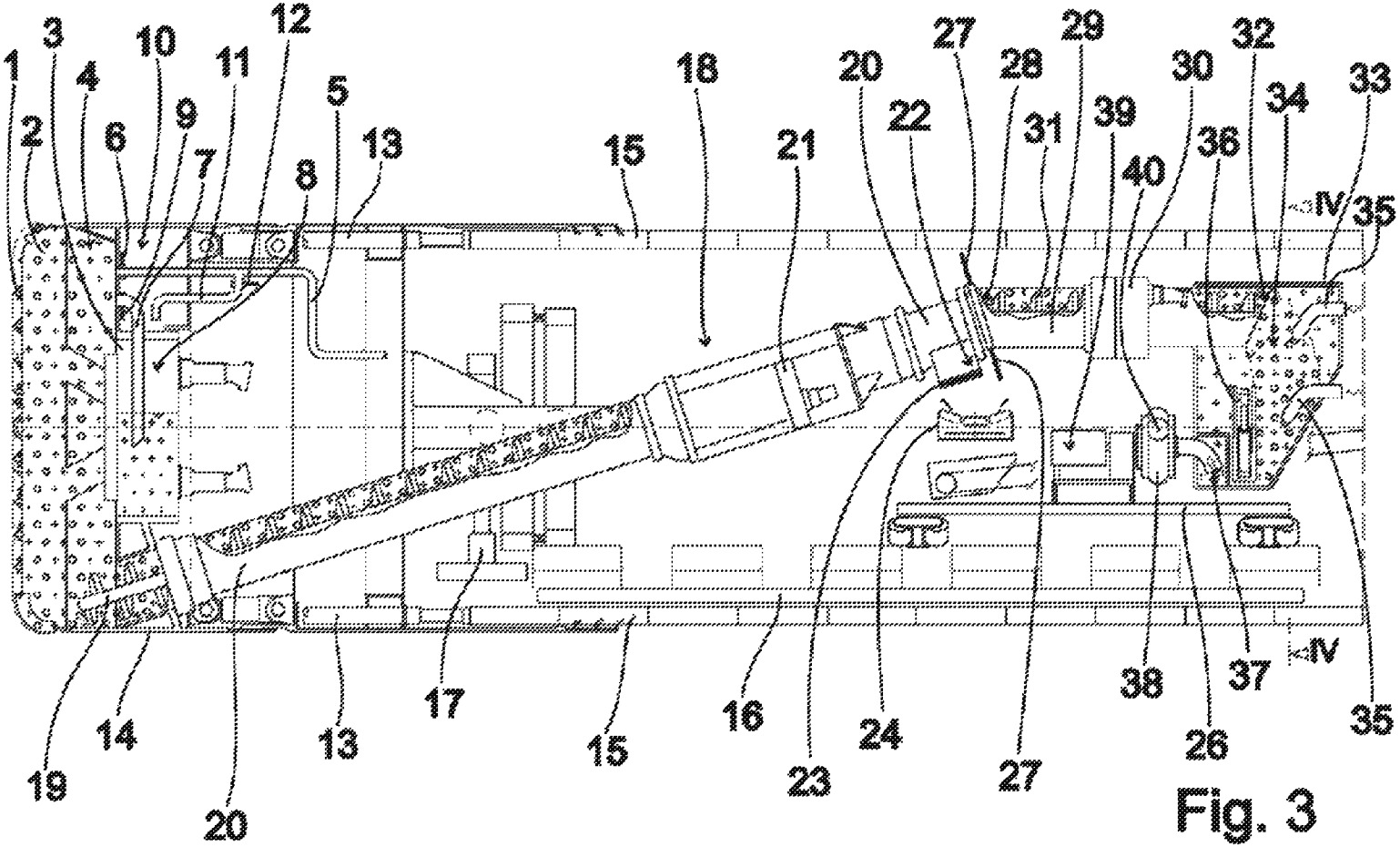
FIG. 3 is a descriptive side view of the exemplary embodiment according to FIG. 1 engaged in slurry tunneling.

FIG. 3 is a descriptive side view of the arrangement according to FIG. 1 engaged in slurry tunneling, in which, on the one hand, the working chamber slide valve 6, the overflow line slide valve 9 and the annular gap slide valve 12 are open in order to maintain the slurry feed necessary for slurry tunneling and the corresponding pressure conditions in the working chamber 4 and the buffer chamber 8. On the other hand, in slurry tunneling the main screw conveyor outlet sealing slide valves 23 are closed and the transitional-opening throughpass slide valve 27 is open, and consequently the transitional-opening throughpass 28 located between the main screw conveyor cladding tube 20 and the downstream screw conveyor cladding tube 29 is now open and material containing excavated material destined for removal and conveyed by the main screw conveyor 19 can be conveyed into the downstream screw conveyor cladding tube 29 and, by means of the downstream screw conveyor 31 rotating in a conveying direction, can be carried on through the downstream screw conveyor outlet 32 into the flushing chamber 34 surrounded by the flushing box 33. In the flushing chamber 34, in slurry tunneling, as indicated schematically by the arrows in FIG. 3, flushing liquid can be introduced into the flushing chamber 34 through the flushing-chamber flushing-liquid feed lines 35 to lend the material for removal a suitable consistency for the operating parameters of the feed pump 38.

Figure 4:
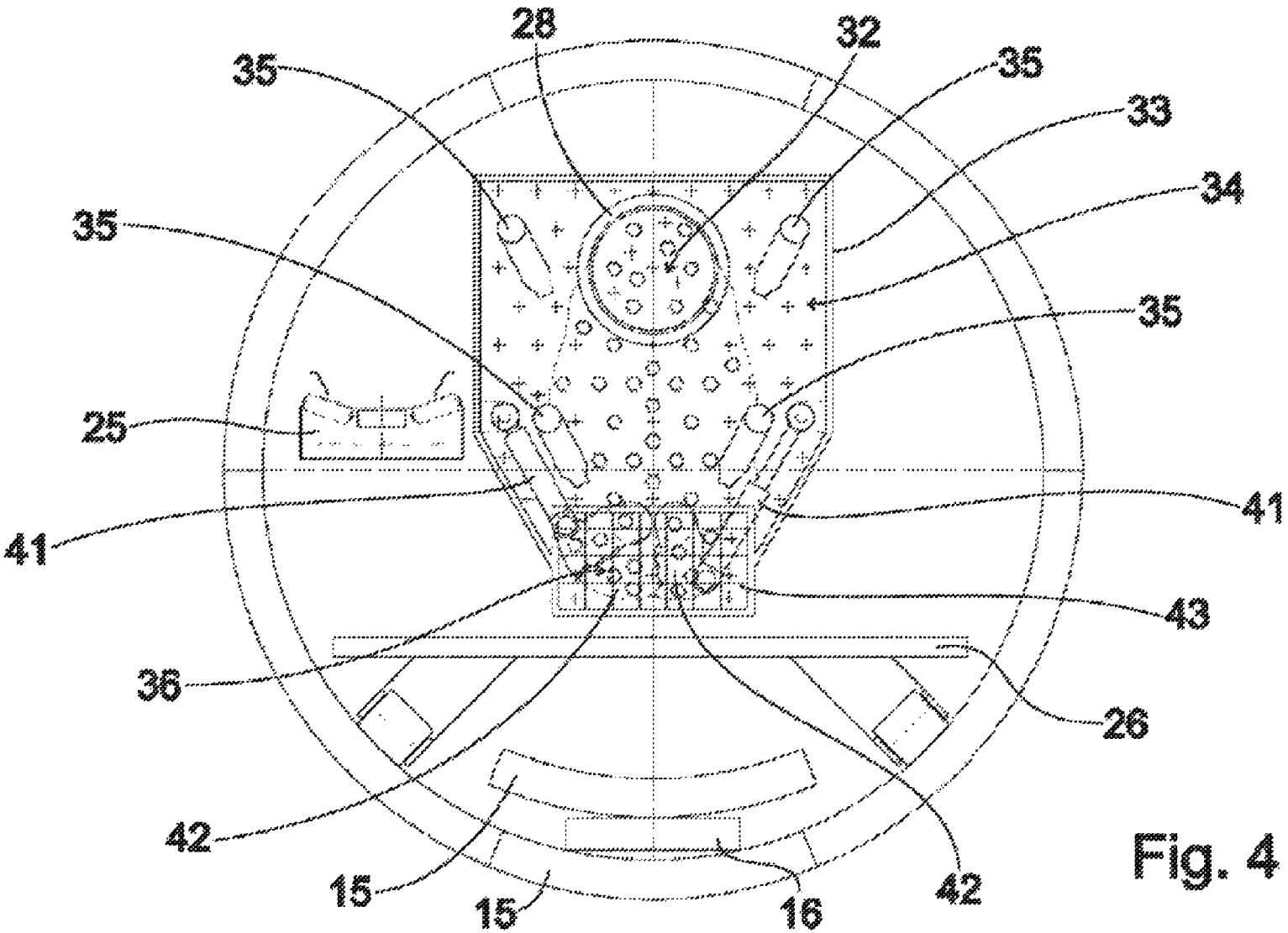
FIG. 4 shows the exemplary embodiment according to FIG. 3 in a sectional view along line IV-IV.

FIG. 4 shows the arrangement according to FIG. 3 in a sectional view along line IV-IV. Particularly apparent in FIG. 4 is the configuration of the jaw crusher 36, with crusher jaws 42 that are operable via pressure cylinders 41 and by means of which the material in the flushing chamber 34, which can include relatively large-size components, can be reduced in size sufficiently to pass through a screen 43 disposed in front of the feed line suction pipe 37.

Figure 5:
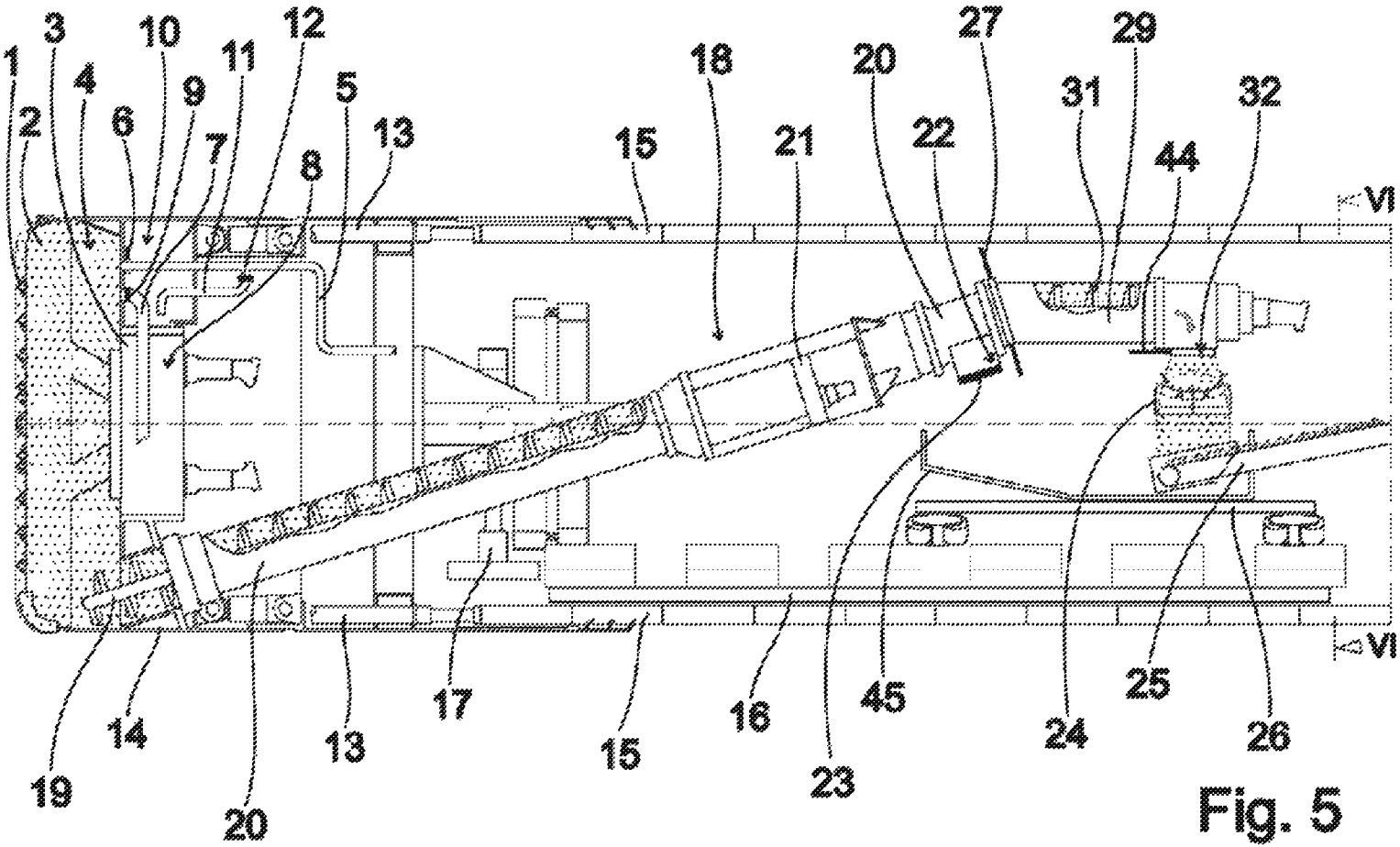
FIG. 5 is a descriptive side view of a variant of the exemplary embodiment according to FIG. 1.

FIG. 5 is a descriptive side view of a modification of the exemplary embodiment described with reference to FIGS. 1 to 4, it being noted that like elements of the exemplary embodiment according to FIGS. 1 to 4 and the modification according to FIG. 5 have been given the same reference numerals and that, to avoid repetition, some of them will not be described again in greater detail. In the modification according to FIG. 5, for EPB mode, the transverse conveyor belt 24 and the backup conveyor belt 25 are positioned in the region of a downstream screw conveyor outlet sealing slide valve 44 that is disposed at the downstream screw conveyor outlet 32 and is open in this mode of operation; in contrast to the exemplary embodiment according to FIGS. 1 to 4, here the flushing box 33 and the feed pump 38 have been removed. In addition, in the modification according to FIG. 5, provided in the region of the downstream screw conveyor cladding tube 29 and the downstream screw conveyor 31 is a drip pan 45 that rests on the backup system 26.

Figure 6:
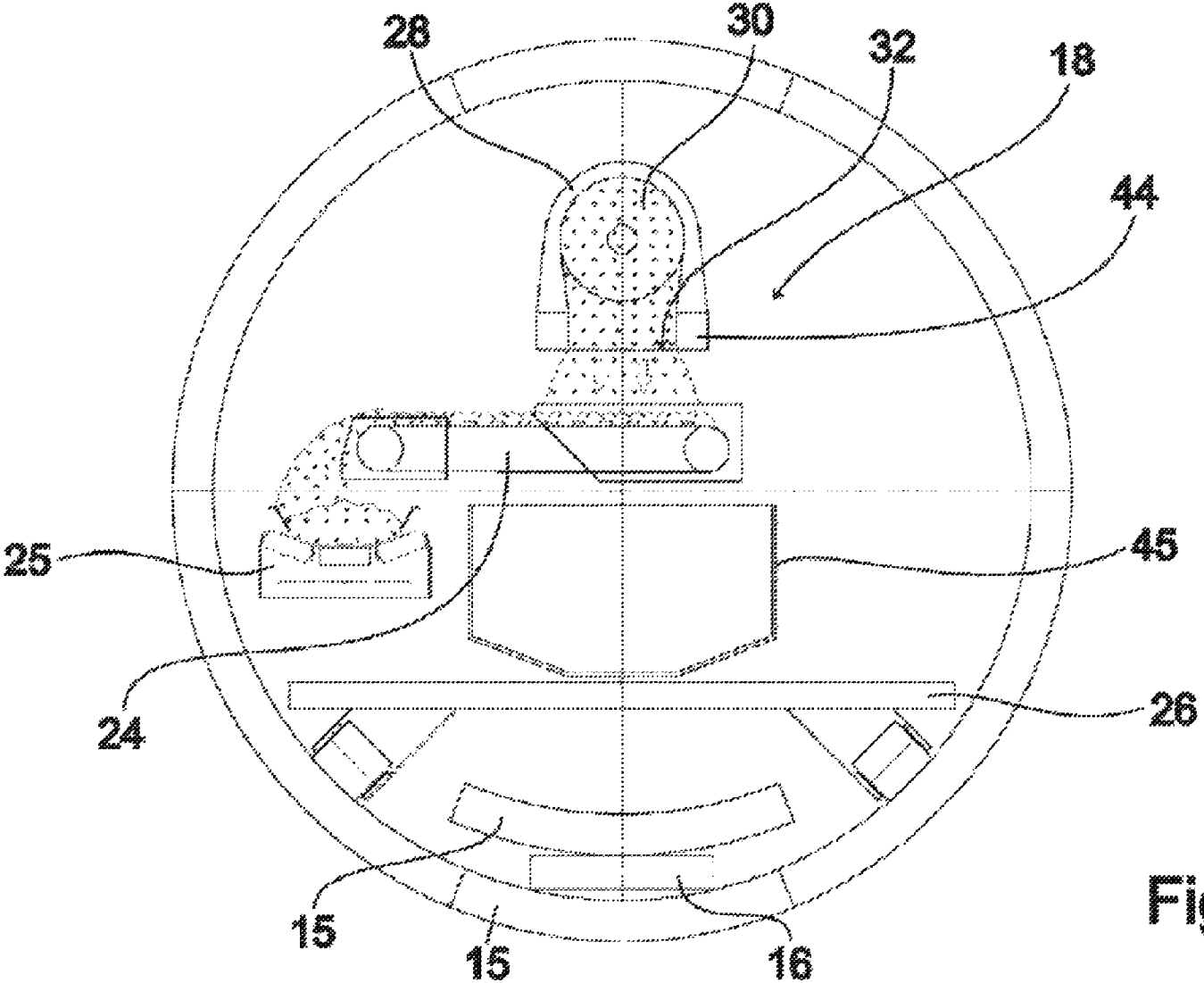
FIG. 6 shows the exemplary embodiment according to FIG. 5 in a sectional view along line VI-VI.

FIG. 6 shows the modification according to FIG. 5 in a sectional view along line VI-VI, looking in the tunneling direction. It can be seen from FIG. 6 that, as in the exemplary embodiment according to FIG. 2, material emerging from the downstream screw conveyor outlet 32 over the drip pan 45 is carried off via the transverse conveyor belt 24 and the backup conveyor belt 25.

Figure 7:
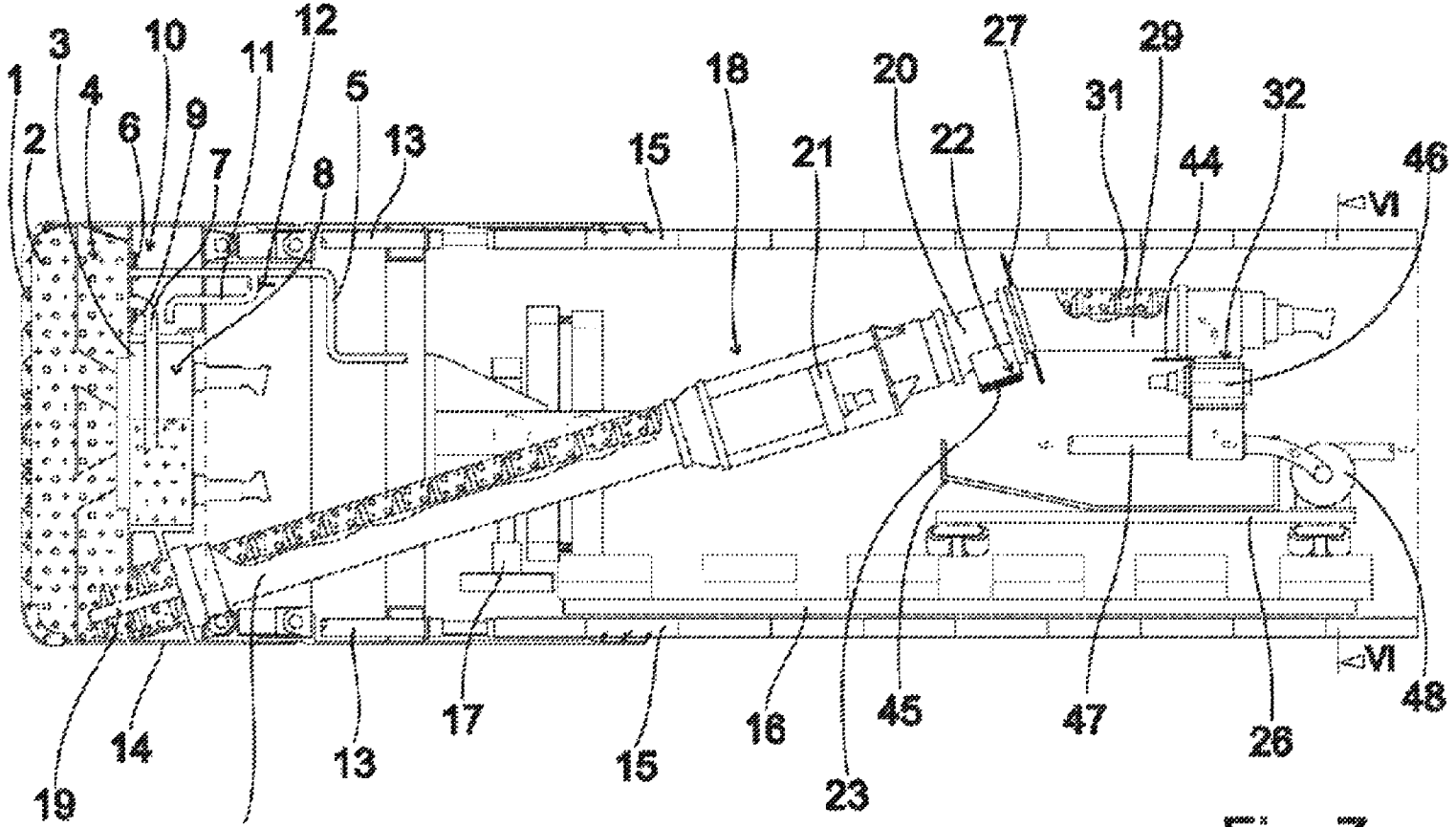
FIG. 7 is a descriptive side view of the exemplary embodiment according to FIG. 5 engaged in slurry tunneling.

FIG. 7 is a descriptive side view of the modification described above with reference to FIGS. 5 and 6, but in which, for the slurry tunneling operation depicted in FIG. 7, a drum crusher 46 is disposed at the downstream screw conveyor outlet 32 to reduce the size of the material conveyed via the main screw conveyor 19 and the downstream screw conveyor 31 before it enters a removal line 47 and a feed pump 48.

Figure 8:
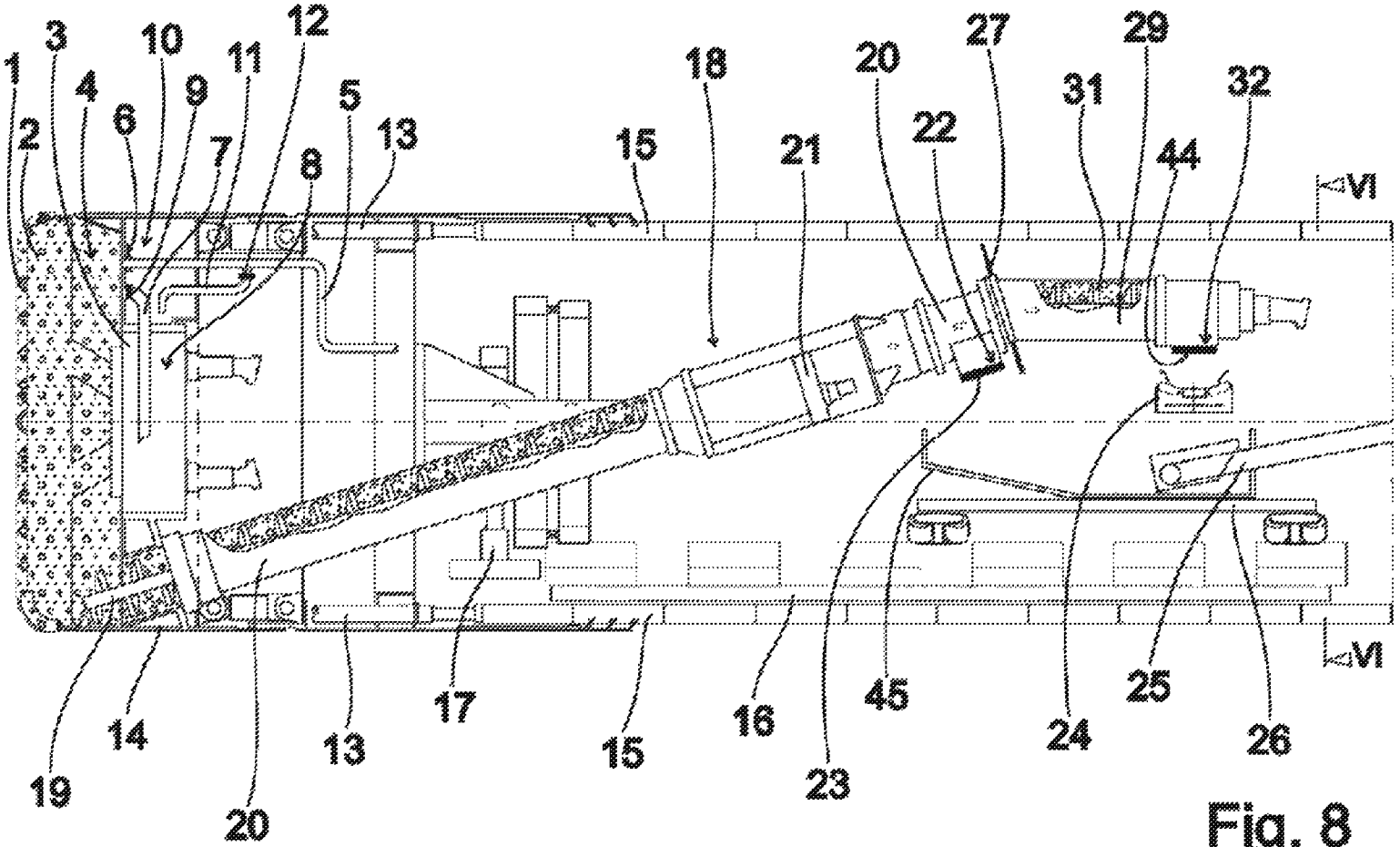
FIG. 8 is a descriptive side view of the exemplary embodiment according to FIG. 5 in a discontinuous airlock discharge mode in a first operating state.

FIG. 8 shows the arrangement according to FIG. 5 in a discontinuous airlock discharge mode in a first operating state, wherein, starting with earth pressure balance tunneling or open tunneling to get through a relatively short region where, for example, there is a high afflux of water or high pressure during tunneling, the transitional-opening throughpass slide valve 27 is open and the downstream screw conveyor outlet 32 is closed, so the downstream screw conveyor cladding tube 29 is filled during tunneling.

Figure 9:
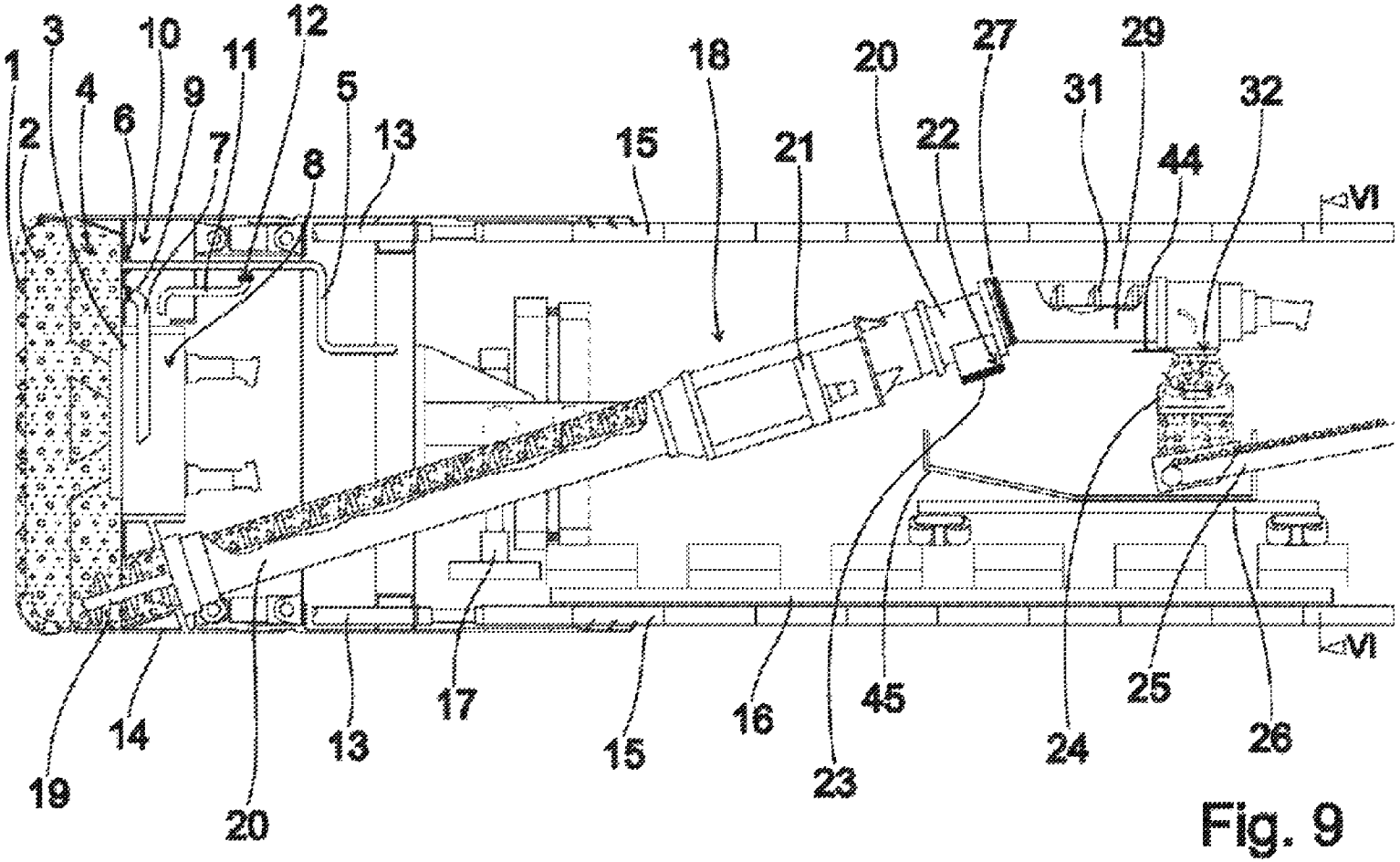
FIG. 9 is a descriptive side view of the exemplary embodiment according to FIG. 5 in the discontinuous airlock discharge mode in a second operating state.

FIG. 9 shows the arrangement according to FIG. 5 in the discontinuous airlock discharge mode in a second operating state, wherein, with no tunneling taking place, the transitional-opening throughpass slide valve 27 is closed and the downstream screw conveyor outlet 32 is open, so that the contents of the downstream screw conveyor cladding tube 29 can be removed via the transverse conveyor belt 24 and the backup conveyor belt 25. The system then returns to the first operating state of the discontinuous airlock discharge mode illustrated in FIG. 8, and the alternation between operating states in discontinuous airlock discharge mode continues until the critical region has been discontinuously traversed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method for conveying excavated material away during tunneling, comprising the following steps:

providing a first conveying system and a second conveying system, the second conveying system disposed downstream of the first conveying system;

opening, in a first mode of operation, a first opening of the first conveying system together with closing a second opening located downstream of the first opening and between the first and second conveying systems to separate the first and second conveying systems;

operating the first conveying system in the first mode of operation with the second conveying system deactivated;

closing, in a second mode of operation, the first opening, together with opening the second opening;

operating both the first and second conveying systems in the second mode of operation;

wherein the first mode of operation is one of an open tunneling operation and an earth pressure balance operation and the second mode of operation is a slurry tunneling operation.

2. The method of claim 1, wherein said closing step further comprises removing material from a flushing chamber.

3. The method of claim 2, wherein said closing step further comprises introducing flushing liquid into the flushing chamber.

* * * * *